US007255636B2

(12) United States Patent
Hu et al.

(10) Patent No.: US 7,255,636 B2
(45) Date of Patent: Aug. 14, 2007

(54) HYBRID BURNISHING HEAD DESIGN FOR IMPROVED BURNISHING OF DISK MEDIA

(75) Inventors: Yong Hu, Fremont, CA (US); Pranesh K. Swamy, San Jose, CA (US); Eric K. Dahlin, San Jose, CA (US); Hamid F. Ghazvini, San Jose, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 57 days.

(21) Appl. No.: 11/153,685

(22) Filed: Jun. 16, 2005

(65) Prior Publication Data

US 2006/0286912 A1 Dec. 21, 2006

(51) Int. Cl.
*B24B 25/00* (2006.01)

(52) U.S. Cl. ..... 451/319; 451/324; 451/552; 29/603.12; 360/235.4; 360/236.4; 360/237

(58) Field of Classification Search ..... 451/552, 451/527, 530, 312, 319, 324; 29/90.01, 603.12; 73/105; 360/235.4, 236.4, 236.5, 236.6, 360/236.7, 237
See application file for complete search history.

(56) References Cited

U.S. PATENT DOCUMENTS 4,330,910 A 5/1982 Schachl et al.
4,430,782 A 2/1984 Bornhorst et al.
4,845,816 A 7/1989 Nanis
5,658,191 A * 8/1997 Brezoczky ..... 451/324
6,249,945 B1 6/2001 Lee
6,342,707 B1 1/2002 Cromwell et al.
6,357,095 B1 3/2002 Duan et al.
6,497,021 B2 * 12/2002 Lee et al. ..... 29/90.01
6,503,132 B2 * 1/2003 Ekstrum et al. ..... 451/312
6,526,639 B2 3/2003 Duan et al.
6,530,258 B2 3/2003 Brannon et al.
6,666,076 B2 * 12/2003 Lin et al. ..... 73/105
6,927,942 B2 * 8/2005 Tani et al. ..... 360/235.6
2005/0185343 A1 * 8/2005 Agrawal et al. ..... 360/237

* cited by examiner

*Primary Examiner*—Eileen P. Morgan
(74) *Attorney, Agent, or Firm*—McDermott Will & Emery LLP

(57) ABSTRACT

A hybrid burnishing head for processing of surfaces of hard disk media comprises a solid body including a first major surface and a second, opposed major surface comprising a burnishing surface including first and second surface portions, wherein the first surface portion is configured for providing air bearing stability and flyability of the head over the media surface, the second surface portion is configured for providing burnishing of a media surface, and the first and second surface portions are operatively decoupled for simultaneously providing optimized air bearing stability/flyability and burnishing aggressiveness for a particular application.

10 Claims, 3 Drawing Sheets

HYBRID BURNISHING HEAD DESIGN FOR IMPROVED BURNISHING OF DISK MEDIA

FIELD OF THE DISCLOSURE

The present disclosure relates to a novel burnishing head design for providing improved smoothening (burnishing) of hard disk information storage and retrieval media, e.g., magnetic disks, magneto-optical (MO) disks, etc.

BACKGROUND DISCUSSION

Information storage and retrieval devices, such as magnetic and MO hard drive devices utilized in computer devices are comprised of a magnetic or MO hard disk recording/storage medium mounted on a spindle, which is driven by a motor to effect high speed rotation of the disk. A read/write transducer ("head") maintained in close proximity to the surface of the rotating disk, reads or writes data on the disk. The read/write head is separated from the disk surface by an air bearing created by the high speed rotation of the disk. The read/write head "flies" on the air bearing at a very close separation distance ("flying height") from the disk surface, i.e., on the order of microinches. The closer the read/write head is to the disk surface, the more information may be written to and read from the disk. Thus, it is desirable for the read/write head to "fly" as close as possible to the surface of the disk.

Recording media in the form of magnetic disks typically comprise a non-magnetic substrate such as of Al or an Al-based alloy, a NiP layer plated on the substrate, polished and then textured, an underlayer, e.g., of Cr or NiP deposited on the NiP plated layer, a thin film of a magnetic recording material (typically a Co-based alloy), a protective overcoat layer formed on the magnetic film, and a lubricant topcoat layer on the protective overcoat layer.

Magnetic disk manufacturing specifications typically require that asperities, protrusions, and depressions on the surface of the disk are smaller than a preselected size. The precision with which the read/write head flies over the disk surface requires that care is taken during the manufacturing processing to assure that there are no protrusions or asperities on the disk surface that may interfere with operation of the read/write head. For example, a protrusion on the surface of the disk that contacts the read/write head may damage the head and/or the disk.

Accordingly, during manufacture of magnetic or MO disks, tests are performed with "media certifiers" using, e.g., "glide heads", to ensure that there are no defects, such as asperities, voids, projections, or contaminants present on the disk surface that might interfere with operation of the read/write head. Accurate testing of disks for such defects assures that the disk manufacturer does not unnecessarily reject good quality disks or pass on poor quality disks that may later fail in operation.

A typical certification process for hard disks involves mounting each disk individually on a spindle, which is rotated at a high speed while a burnishing head is moved across the surface to remove loose debris and condition the disk surface, followed by moving a glide head across the disk surface to check for asperities and defects. Conventionally, the burnishing head is designed as a flying head which passes over the disk surface to be burnished at a very small spacing which may even be less than the normal spacing between the disk surface and the read/write head.

The escalating requirements for high areal recording density magnetic media dictate media with ultra-smooth surfaces and ultra-thin protective overcoat layers for minimizing transducer head/disk surface separation distances, i.e., reduced flying heights approaching a near-contact situation. However, as the transducer head/disk interface of magnetic hard drives approach the near-contact regime, the number of thermal asperities (TA's) detected by the read/write transducer heads rapidly increase to an unmanageable level. These TA's, which result from a strong interaction from the flying transducer head and a defect on the disk surface, not only cause the recording tracks to be unusable for data recording, but also degrade the magnetic heads and potentially cause failure of the entire disk drive. The disadvantageous interaction resulting in TA formation can result from contact or non-contact situations, as long as they induce a sudden change in the head/media spacing. Hence, it is imperative that reducing media defects is key for ensuring good reliability of magnetic hard drives.

One of the most important processes for reducing media defects is the burnishing process. As indicated above, the objective of the burnishing is to remove the loose/soft particles and asperities from the media surface and to condition the surface. However, the continuing drive for thinner protective overcoat layers for better recording performance demands a delicate burnishing. Burnishing too aggressively will scratch the disks, and burnishing too gently will not create a flyable surface. In addition, the deteriorating wear and scratch resistance of the media surface due to the ultra-thin overcoat layer renders the disk surface more prone to particle embedding.

Conventional burnishing heads typically include burnishing surfaces comprised of a plurality of waffle- or elliptically-shaped discrete projections or pads distributed over the entire air-bearing burnishing surface. FIG. 1 is a plan view of the burnishing surface of a typical elliptical pad burnishing head. Due to their small size and discrete nature, pads configured in such waffle or elliptically-shaped manner cannot efficiently compress incoming air at the leading edge, resulting in poor flying stability and large head-to-head variation in the fly height. In either instance, it is virtually impossible to fine-tune the aggressiveness of the burnishing process and maintain a consistent/stable burnishing performance.

FIG. 2 is a plan view of the burnishing surface of a more recent burnishing head design of "straight-rail" type affording superior flying stability and improved fly height control vis-à-vis the waffle- or elliptically-shaped type head such as illustrated in FIG. 1. However, burnishing heads of the type shown in FIG. 2 disadvantageously lack aggressive, or sandpaper-type burnishing action and good particle rejection.

In view of the foregoing, there exists a clear need for improved burnishing head designs for use with current high performance magnetic or MO disk media which provide optimized burnishing performance with a sufficient degree of burnishing.

The present invention, therefore, addresses and solves the above-described problems, drawbacks, and disadvantages associated with the conventional burnishing heads and methodology utilized for the manufacture of high performance magnetic and MO recording media in disk form, while maintaining full compatibility with all aspects of automated disk manufacture.

SUMMARY OF THE DISCLOSURE

An advantage of the present disclosure is an improved, hybrid burnishing head for processing of surfaces of hard disk media.

Another advantage of the present disclosure is a method for fabricating an improved, hybrid burnishing head for processing of surfaces of hard disk media.

Additional advantages and other features of the present disclosure will be set forth in the description which follows and in part will become apparent to those having ordinary skill in the art upon examination of the following or may be learned from the practice of the present disclosure. The advantages of the present disclosure may be realized and obtained as particularly pointed out in the appended claims.

According to an aspect of the present disclosure, the foregoing and other advantages are obtained in part by a hybrid burnishing head for processing of surfaces of hard disk media, comprising:

a solid body including first and second opposed major surfaces, the second major surface comprising a burnishing surface including first and second surface portions, wherein:

the first surface portion is configured for providing air bearing stability and flyability of the head over the media surface;

the second surface portion is configured for providing burnishing of a media surface; and the first and second surface portions are operatively decoupled for simultaneously providing optimized air bearing stability/flyability and burnishing aggressiveness for a particular application.

According to a preferred embodiment, the burnishing surface comprises a first pair of laterally extending side edges and a second pair of transversely extending side edges forming leading and trailing edges of the burnishing head; the first surface portion comprises at least one continuous rail extending towards the leading edge, including a leading edge taper or step for providing compression of incoming air and a stable air bearing during burnishing operation, and further including at least one open side channel for flushing away of particles during burnishing operation.

According to other preferred embodiments, the burnishing head comprises a continuous rail adjacent each of the first pair of side edges and extending towards the leading edge, and further comprises at least one continuous rail extending toward the trailing edge; each of the continuous rails being configured as a polygon having at least three sides.

Preferred embodiments of the present disclosure include those wherein the second surface portion comprises a plurality of spaced apart, raised burnishing pads extending from the second major surface; each of the plurality of burnishing pads is generally conically, elliptically, pyramidally, or square-shaped, and includes a leading edge taper or step for flushing away of particles during burnishing operation. Further preferred embodiments include those wherein the plurality of burnishing pads are arranged in columns and rows.

According to another aspect of the present disclosure, a method of fabricating a hybrid burnishing head for processing of surfaces of hard disk media comprises steps of:

(a) providing a solid body including first and second opposed major surfaces; and (b) forming a burnishing surface on the second major surface, the burnishing surface including first and second surface portions, the first surface portion being configured for providing air bearing stability and flyability of the head over the media surface and the second surface portion being configured for providing burnishing of a media surface; the first and second surface portions being operatively decoupled for simultaneously providing optimized air bearing stability/flyability and burnishing aggressiveness for a particular application.

According to preferred embodiments of the present disclosure, step (b) comprises forming the burnishing surface with a first pair of laterally extending side edges and a second pair of transversely extending side edges forming leading and trailing edges of the burnishing head; and step (b) further comprises forming the first surface portion with at least one continuous rail extending towards the leading edge and including a leading edge taper or step for providing compression of incoming air and a stable air bearing during burnishing operation, as well as with an open side channel for flushing away of particles during burnishing operation. Preferably, step (b) comprises forming a continuous rail adjacent each one of the first pair of side edges and extending toward the leading edge; (b) further comprises forming at least one continuous rail extending toward the trailing edge; and step (b) comprises forming each of the plurality of continuous rails configured as a polygon having at least three sides.

According to preferred embodiments of the present disclosure, step (b) comprises forming the second surface portion with a plurality of spaced apart, raised burnishing pads extending from the second major surface; wherein step (b) comprises forming generally conically, elliptically, pyramidally, or square-shaped burnishing pads; each of the burnishing pads is formed with a leading edge taper or step for flushing away of particles during burnishing operation; and the burnishing pads as arranged in rows and columns.

Additional advantages and aspects of the present disclosure will become readily apparent to those skilled in the art from the following detailed description, wherein embodiments of the present disclosure are shown and described, simply by way of illustration of the best mode contemplated for practicing the present disclosure. As will be described, the present disclosure is capable of other and different embodiments, and its several details are capable of modification in various obvious respects, all without departing from the spirit of the present disclosure. Accordingly, the drawings and description are to be regarded as illustrative in nature, and not as limitative.

BRIEF DESCRIPTION OF THE DRAWINGS

The following detailed description of the embodiments of the present disclosure can best be understood when read in conjunction with the following drawings, in which the like reference numerals are employed throughout for designating similar features and the various features are not necessarily drawn to scale but rather are drawn as to best illustrate the pertinent features, wherein.

DETAILED DESCRIPTION OF THE EMBODIMENTS

Figure 1:
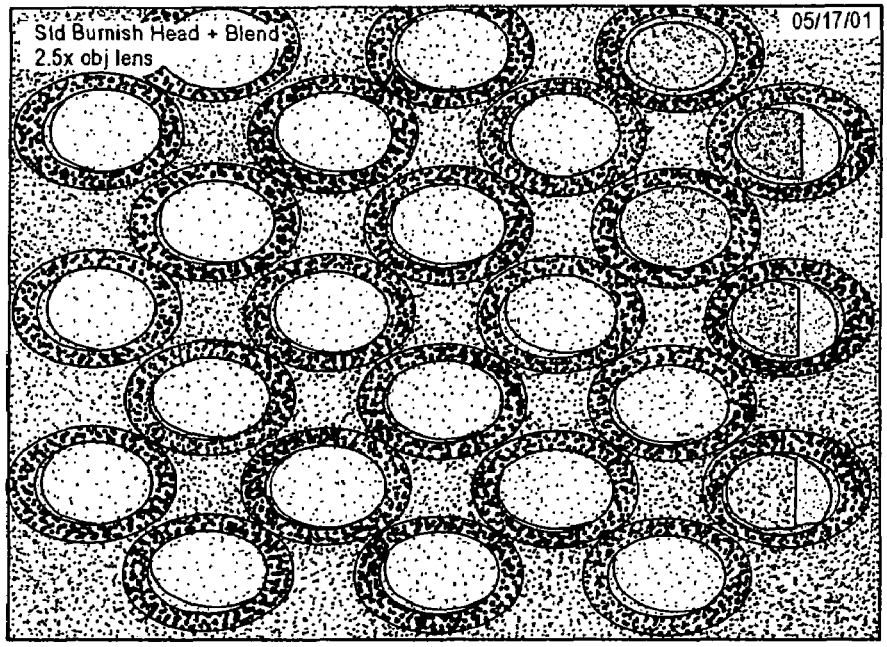
FIG. 1 is a plan view of the burnishing surface of a burnishing head with a plurality of elliptically-shaped burnishing pads.

The present disclosure addresses and solves problems associated with the fabrication of contemporary high performance magnetic and MO recording media, typically in disk form, with ultra-smooth surfaces and ultra-thin protective overcoats, where burnishing of the media surfaces is performed for reducing defects of various types, such as loose particles and asperities. The ultra-thin protective overcoat layers of contemporary magnetic and MO disk media require extremely delicate control of the burnishing process, as burnishing too aggressively results in scratching of the disk surfaces and burnishing too gently results in surfaces with poor flyability of the read/write transducer head(s). Moreover, the deteriorating wear and scratch resistance of the media surfaces due to the ultra-thin protective overcoats renders the media surfaces more prone to particle embedding therein. The present disclosure, therefore, is based upon recognition by the inventors that the burnishing heads utilized for burnishing processing of contemporary high performance magnetic and MO disk media must be optimized for providing burnishing performance consistent with the ultra-smooth surfaces and ultra-thin protective overcoat layers of such media.

More specifically, the present disclosure is based upon recognition that previous burnishing head designs, such as those comprising a plurality of raised burnishing pads or a plurality of continuous rails, are incapable of providing the requisite delicate control of the burnishing process when utilized with contemporary high performance media. For example, a burnishing head comprised of a spaced plurality of elliptically-shaped pads distributed over the entire air-bearing surface, such as of the type shown in FIG. 1, cannot create an efficient compression of the incoming air due to their small size and discrete nature, leading to poor flying stability and large head-to-head variation of fly height. As a consequence, it is impossible to fine-tune the burnishing aggressiveness and maintain consistent/stable burnishing performance. On the other hand, a burnishing head with a straight-rail configuration, e.g., of the type shown in FIG. 2, exhibits improved flying stability and fly height control, at the expense of sandpaper-type burnishing action and particle rejection.

According to the present disclosure, a novel "hybrid" burnishing head is provided which combines the best, most advantageous features of the above-described discrete pad and continuous rail types of burnishing heads, wherein the advantages afforded by the two types are decoupled. That is, according to the present disclosure, the hybrid burnish head design decouples the overall burnishing performance into separate components: (1) the air bearing stability/flying consistency as controlled by the well-separated continuous rails of the FIG. 2 design including a leading edge taper or step, as well as their shape and placement; and (2) the sandpaper-type burnishing action as created by the FIG. 1 design by the pattern of discrete, separated pads, including their shape and distribution. The decoupled air-bearing surface ("ABS") features of the present disclosure readily enable fine-tuning of both the burnishing aggressiveness and air bearing stability and flyability of the burnishing head, resulting in a scalable/tunable solution for testing and burnishing of contemporary and future media.

Briefly stated, hybrid burnishing heads according to the present disclosure comprise burnishing surfaces with a pair of essential ABS features: well-separated continuous rails and distributed pads. Rail shape and placement are designed based upon the same design strategy commonly employed in the drive product air bearing surfaces. The main objectives of the continuous rails including a taper or step at their leading edge are to provide an effective compression of the incoming air and create a stable air bearing. The air bearing stability and flyability os easily adjusted by modifying the taper or step of the leading edge, and the number, size, shape, and placement of the continuous rails.

On the other hand, the pads, due to their small size and discrete nature, generate only a small amount of air bearing pressure but advantageously provide sandpaper-type burnishing action, including removal of loose particles on the media surface, cutting of soft asperities such as lubricant spikes, and conditioning of the disk surface. The degree of surface burnishing and conditioning is readily fine-tuned by modifying the pad size, shape, and distribution.

Figure 2:
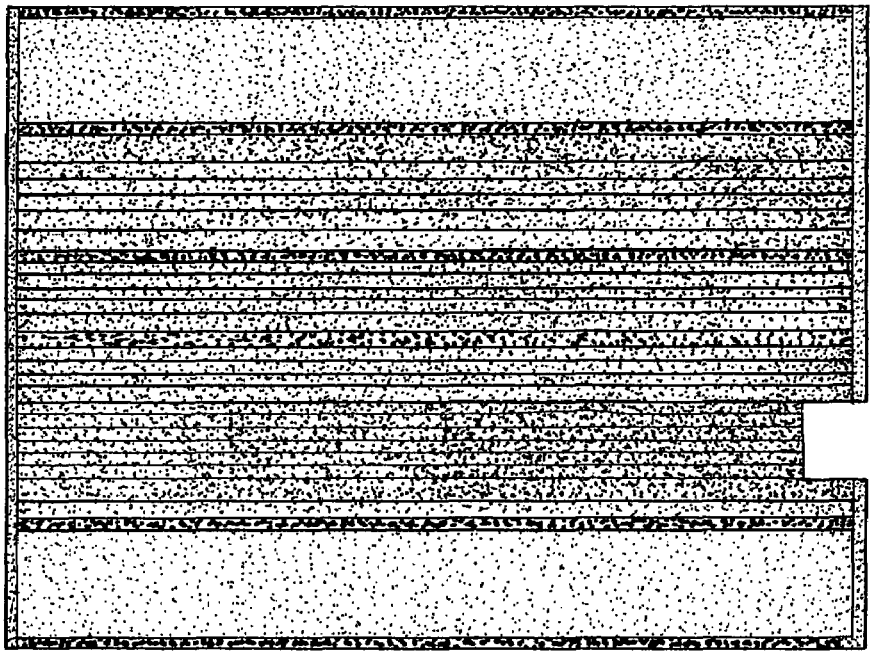
FIG. 2 is a plan view of the burnishing surface of a "catamaran" type burnishing head with a pair of continuous burnishing rails.

According to the disclosure, the enhanced air bearing stability and flyability provided by the continuous rails creates a highly desirable operating environment for the burnishing pads to perform a more consistent and effective removal of loose particles, cutting of soft asperities, and surface conditioning than heretofore possible with the discrete pad and continuous rail-type burnishing pad designs such as shown in FIGS. 1-2. Essentially, the instant burnishing head designs have decoupled the air-bearing surface in terms of air bearing stability and sandpaper-type burnishing action, advantageously facilitating accurate design and tailoring of air bearing surface (ABS) and aggressiveness of the burnishing action. In this regard, it is noted that the ability to fine-adjust these competing factors is crucial for the development of media testing and burnishing demanding great delicacy due to the ultra-thin protective overcoat.

Additional features incorporated in the hybrid burnishing head designs according to embodiments of the present disclosure include angled surfaces of the leading edge taper or step of the continuous rail(s), at least one rear rail at the trailing edge, burnish pads, and open side channels. The angled surfaces of the leading edge tapers or steps reflect incoming particles away and prevent them from entering the air bearing surface. Particles entering the head-disk interface from the central leading edge area are met with the angled surfaces of the burnishing pads and the rear rail and are flushed out of the interface through the angled open side channels. Since the hybrid designs according to the disclosure have multiple layers of burnishing pads and open side channels, the probability of a particle reaching the trailing edge is very low, hence reducing the number of embedded particles. The effectiveness of this action affording a significant reduction in embedded particles is readily optimized by tailoring the angles of the taper and pad surfaces, pad size, and side channel size and angle.

Figure 3:
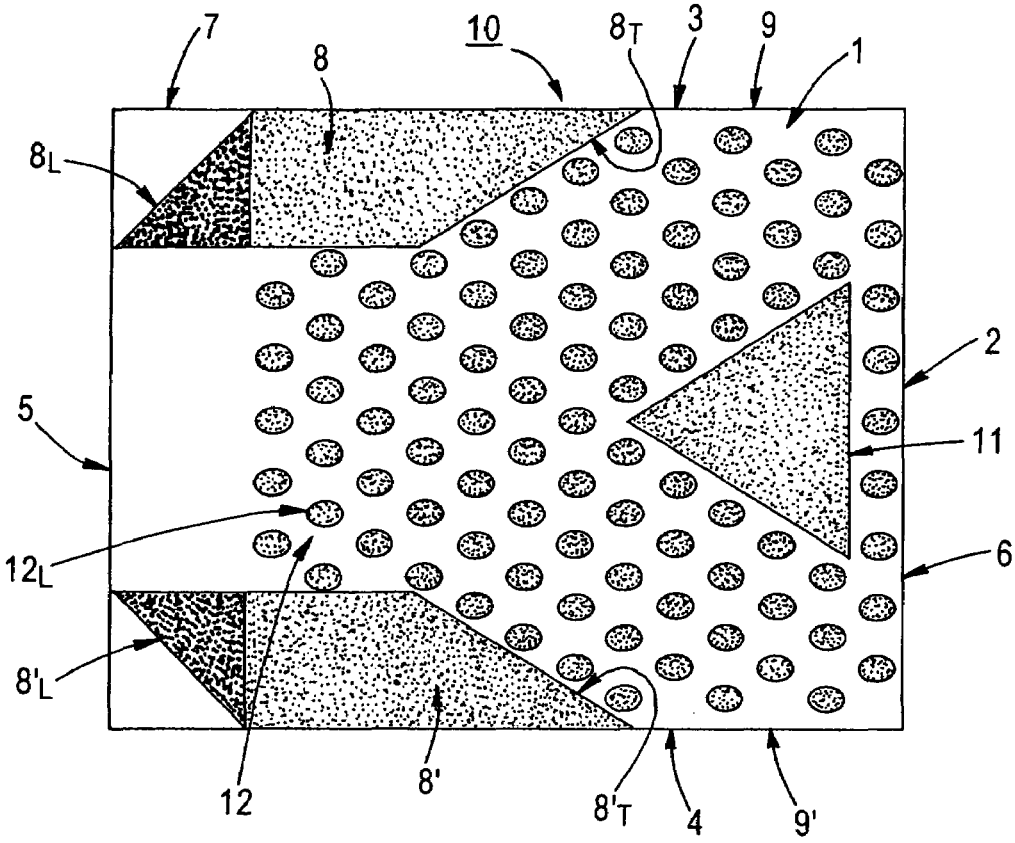
FIG. 3 is a plan view of the burnishing surface of a hybrid burnishing head according to an embodiment of the present disclosure and comprising a plurality of elliptically-shaped burnishing pads and a plurality of continuous burnishing rails.

Referring to FIG. 3, shown therein is a plan view of the burnishing surface 1 of a hybrid burnishing head 10 according to an embodiment of the present disclosure. As illustrated, head 10 comprises a generally rectangularly-shaped solid body 2 of a hard, abrasion-resistant material (e.g., a ceramic such as $Al_2O_3$, $Al_2O_3$-TiC, etc.), typically about 0.4 mm (400 μm) thick, having a first pair of parallel, laterally extending (i.e., longer) side edges 3, 4 typically from about 1.25 to about 2 mm long, depending upon the particular application, and a second pair of parallel, transversely extending (i.e., shorter) side edges 5, 6 typically from about 1 to about 1.6 mm long, with transverse side edge 5 forming a leading edge during operation and transverse side edge 6 forming a trailing edge. Portion 7 of burnishing surface 1 adjacent to and including leading edge 5 is tapered or stepped downwardly from surface 1 and includes an angled leading portion $\mathbf{8}_L$, $\mathbf{8'}_L$ of continuous burnishing rails 8, 8', each of which extends from leading edge 5 along a portion of the respective longer side edge 3, 4. Each rail 8, 8' includes an angularly tapered trailing portion $\mathbf{8}_T$, $\mathbf{8'}_T$ forming an angled, open side channel 9, 9' extending towards trailing edge 6 and facilitating flushing of particles away from the head-disk interface during burnishing operation. By way of illustration only, a 9 mil thick body may have a leading edge taper of about 1 μm or less and the surface of continuous burnishing rail 8 is typically about 5 to about 10 μm above surface 1 of body 2. Another continuous burnishing rail 11, illustratively triangularly-shaped, is centrally located on burnishing surface 1 proximate trailing edge 6. Continuous burnishing rails 8, 8', and 11 constitute a first portion of burnishing surface 1 providing air bearing stability and flyability.

A plurality of spaced-apart, raised burnishing pads 12, illustratively elliptically-shaped and arranged in a row and column pattern, form a second portion of burnishing surface 1 providing sandpaper-type burnishing operation. By way of illustration only, the elliptically-shaped burnishing pads 12 may have 5 μm and 2-3 μm longer and shorter axes, respectively, and be spaced apart from about 10 to about 20 μm. Further, the leading edges $\mathbf{12}_L$ of pads 12 are preferably tapered or stepped so as to aid in flushing particles away from the head-disk interface during burnishing operation.

According to the disclosure, the hybrid design with operatively decoupled first and second portions utilizes enhanced air bearing stability and flyability provided by the continuous rails for creating a highly desirable operating environment for the burnishing pads to perform a more consistent and effective removal of loose particles, cutting of soft asperities, and surface conditioning than heretofore possible with the discrete pad and continuous rail-type burnishing pad designs such as shown in FIGS. 1-2.

The decoupling of the air-bearing surface in terms of air bearing stability and sandpaper-type burnishing action advantageously facilitating accurate design and tailoring of air bearing surface (ABS) and aggressiveness of the burnishing action for any particular application, the ability to fine-adjust these competing factors being crucial for the development of media testing and burnishing demanding great delicacy due to the ultra-thin protective overcoat. In addition, the angled surfaces of the leading edge tapers or steps reflect incoming particles away and prevent them from entering the air bearing surface. Particles entering the head-disk interface from the central leading edge area are met with the angled surfaces of the burnishing pads and the rear rail and are flushed out of the interface through the angled open side channels. The hybrid design with multiple layers of burnishing pads and open side channels reduce the probability of a particle reaching the trailing edge and reduce the number of embedded particles. The effectiveness of this action affording a significant reduction in embedded particles is readily optimized by tailoring the angles of the taper and pad surfaces, pad size, and side channel size and angle.

The instant disclosure admits of a variety of different configurations, for example, as schematically illustrated in FIGS. 4-7. As may be evident from these embodiments, the number, shape, arrangement, spacing, and area occupied by the burnishing pads of the pads may be varied and selected for a particular burnishing application. For example, conically, elliptically, pyramidally, square, or diamond shaped pads are usable according to the principles of the disclosure. Further, the number, polygonal shape, and positioning of each of the continuous rails is variable and may involve angled, e.g., triangular, parallelepiped, or rectangular/square configurations.

Figure 4:
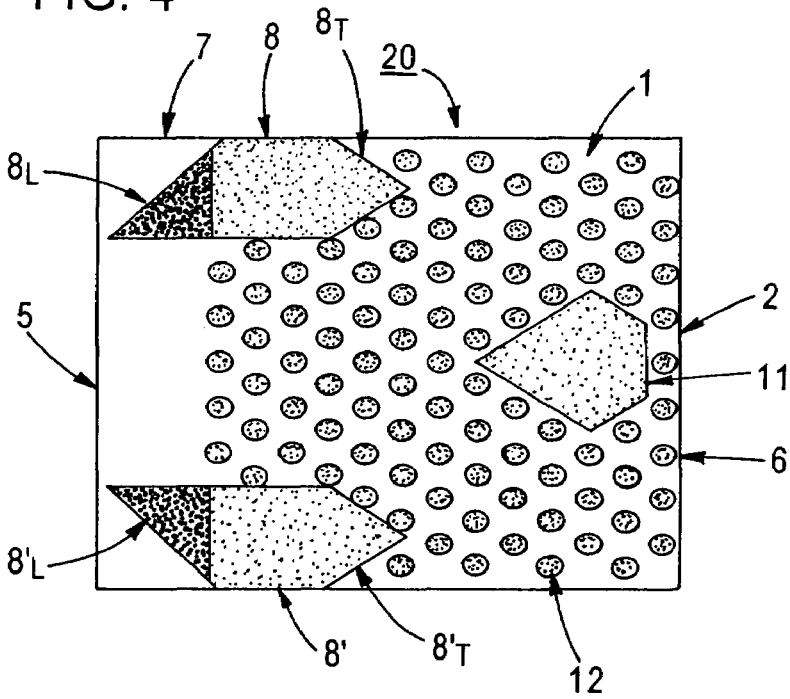
FIGS. 4-7 are plan views of the burnishing surfaces of hybrid burnishing heads according to further embodiments of the present disclosure.
Figure 5:
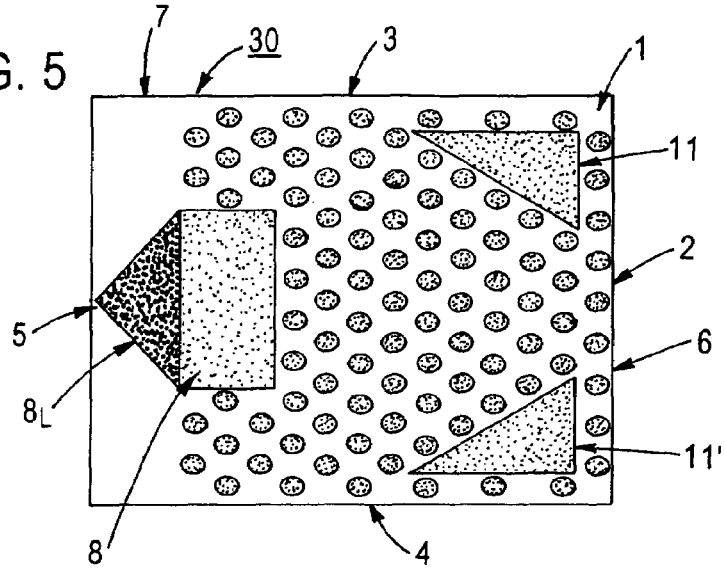
Figure 6:
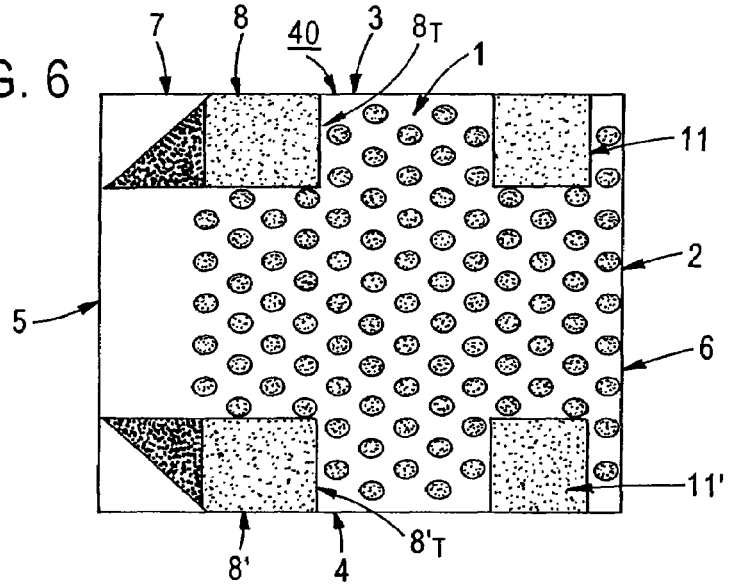
Figure 7:
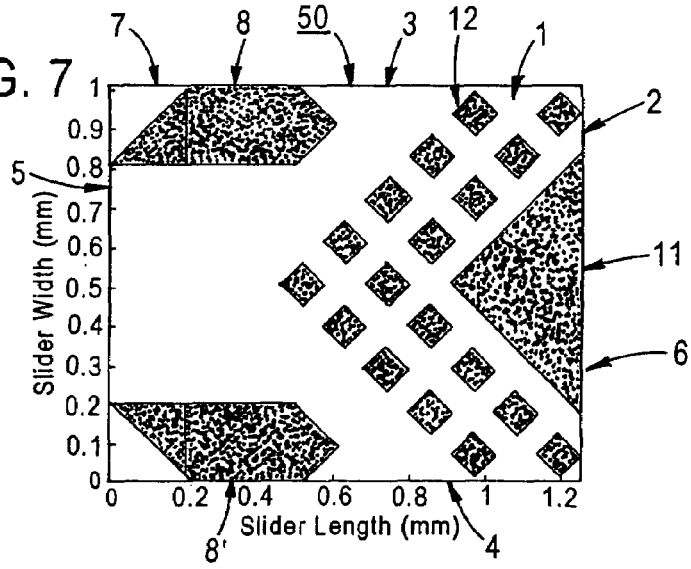

For example, FIG. 4 illustrates an embodiment wherein each of the continuous rails 8, 8', and 11 includes a tapered trailing edge for facilitating particle; FIG. 5 illustrates an embodiment wherein only a single, centrally located continuous rail $\mathbf{8}_L$ is present at leading edge 5 and a pair of right triangle-shaped continuous rails 11, 11' are present adjacent respective side edges 3, 4 at trailing edge 6; FIG. 6 illustrates an embodiment wherein continuous rails 8, 8' each include a perpendicularly oriented trailing edge $\mathbf{8}_T$, $\mathbf{8'}_T$ and continuous rails 11, 11' proximate trailing edge 6 are each square-shaped; and FIG. 7 illustrates an embodiment wherein burnishing pads 12 are square (or diamond)-shaped in cross-section and continuous rail 11 proximate trailing edge 6 is triangularly-shaped.

It should be noted that the above-described embodiments of the disclosure are merely illustrative of the versatility of the instant methodology and principle of decoupled, or hybrid burnishing head design, and thus are not limitative. Specifically, a wide variety of shapes and configurations of the continuous rails and burnishing pads are possible according to the disclosure, and may be tailored for use in a particular burnishing application. Finally, hybrid burnishing head designs according to the disclosure can be fabricated by means of conventional micro-machining, chemical etching, and ion milling techniques known in the art, requiring no further or detailed description herein.

In the previous description, numerous specific details are set forth, such as specific materials, structures, processes, etc., in order to provide a better understanding of the present disclosure. However, the present disclosure can be practiced without resorting to the details specifically set forth. In other instances, well-known processing materials and techniques have not been described in detail in order not to unnecessarily obscure the present disclosure.

Only the preferred embodiments of the present disclosure and but a few examples of its versatility are shown and described in the present disclosure. It is to be understood that the present disclosure is capable of use in various other combinations and environments and is susceptible of changes and/or modifications within the scope of the inventive concept as expressed herein.

What is claimed is:

1. A hybrid burnishing head for processing of surfaces of hard disk media, comprising:

a solid body including first and second opposed major surfaces, said second major surface comprising a burnishing Surface including first and second surface portions, wherein:

said first surface portion is configured for providing air bearing stability and flyability of said head over said media surface; and said second surface portion is configured for providing burnishing of a media surface; wherein:

said burnishing surface comprises a first pair of laterally extending side edges and a second pair of transversely extending side edges forming leading and trailing edges of said burnishing head, and said first surface portion comprises two continuous rails adjacent said laterally extending side edges and a third continuous rail adjacent said trailing edge.

2. The burnishing head as in claim 1, wherein:

said two continuous rails extend towards said leading edge, and said two continuous rails:

include a leading edge taper or step and provide at least one open side channel.

3. The burnishing head as in claim 1, wherein:

each of said continuous rail is configured as a polygon having at least three sides.

4. The burnishing head as in claim 1, wherein:

said second surface portion comprises a plurality of spaced apart, raised burnishing pads extending from said second major surface.

5. The burnishing head as in claim 4, wherein:

each of said plurality of burnishing pads is generally conically, elliptically, pyramidally, or square-shaped.

6. The burnishing head as in claim 5, wherein:

each of said burnishing pads includes a leading edge taper or step for flushing away of particles during burnishing operation.

7. The burnishing head as in claim 4, wherein: said plurality of burnishing pads are arranged in columns and rows.

8. The burnishing head as in claim 1, wherein said first portion further comprises a fourth continuous rail adjacent the trailing edge.

9. A hybrid burnishing head for processing of surfaces of hard disk media, comprising:

a solid body including first and second opposed major surfaces, said second major surface comprising a burnishing surface including first and second surface portions, wherein:

said first surface portion is configured for providing air bearing stability and flyability of said head over said media surface;

said second surface portion is configured for providing burnishing of a media surface;

said burnishing surface comprises a first pair of laterally extending side edges and a second pair of transversely extending side edges forming leading and trailing edges of said burnishing head, said second surface portion further comprising one continuous rail adjacent said leading edge and two continuous rails adjacent said trailing edge.

10. The burnishing head as in claim 9, wherein: said one continuous rail includes a leading edge taper or step.

* * * * *